United States Patent [19]

Voigt et al.

[11] 4,419,845

[45] Dec. 13, 1983

[54] METHOD OF AND APPARATUS FOR FINISH-GRINDING A CAMSHAFT

[75] Inventors: Heinz Voigt; Martin Wolters, both of Wuppertal, Fed. Rep. of Germany

[73] Assignee: Ernst Thielenhaus KG, Wuppertal, Fed. Rep. of Germany

[21] Appl. No.: 246,704

[22] Filed: Mar. 23, 1981

[30] Foreign Application Priority Data

Mar. 25, 1980 [DE] Fed. Rep. of Germany ..... 3011454
Mar. 25, 1980 [DE] Fed. Rep. of Germany ..... 3011455

[51] Int. Cl.[3] ..... B24B 5/04
[52] U.S. Cl. ..... 51/42; 51/154
[58] Field of Search ..... 51/154, 42, 281 C, 101 R, 51/103 R, 165.79

[56] References Cited

U.S. PATENT DOCUMENTS 1,622,755 3/1977 Asbridge ..... 51/42 X
1,957,568 5/1934 Wills ..... 51/42 X
4,141,180 2/1979 Gill, Jr. et al. ..... 51/5 R

FOREIGN PATENT DOCUMENTS 596423 3/1978 U.S.S.R. ..... 51/42

*Primary Examiner*—James G. Smith
*Assistant Examiner*—Willmon Fridie, Jr.
*Attorney, Agent, or Firm*—Karl F. Ross; Herbert Dubno

[57] ABSTRACT

A rough-ground camshaft has a shaft extending along and defining an axis and carrying a plurality of axially spaced cams each having a cam surface. This camshaft is finish-ground in system wherein for each cam there is a respective coarse prefinish tool and a respective fine finish tool. Every other cam surface is engaged in one diametrial direction by the respective coarse prefinish tool and in the opposite diametrical direction by the respective fine finish tool, and vice versa for the remaining cams, so that the prefinish tools, like the finish tools, alternate to opposite side of the camshaft axis. The camshaft is rotated about its axis and to start with all of the tools are urged against the respective cams, so that each cam is engaged in one diametrical direction by the respective prefinish tool and in the opposite direction by the respective fine finish tool. This shapes the tools, whereupon the fine finish tools are retracted for prefinishing of the cam surfaces. Then the prefinish tools are retracted and the fine finish tools are engaged with the cams for fine-finishing.

2 Claims, 6 Drawing Figures

METHOD OF AND APPARATUS FOR FINISH-GRINDING A CAMSHAFT

FIELD OF THE INVENTION

The present invention relates to a method of and apparatus for finish-grinding a rough-ground camshaft. more particularly this invention concerns such a method and apparatus wherein the finish-grinding entails a prefinishing with coarse prefinish tools and a subsequent fine finishing with fine finish tools.

BACKGROUND OF THE INVENTION

It is standard procedure in the manufacture of a camshaft, particular the type used in an automotive vehicle to open and close the valves of the internal-combustion engine thereof, to rough-grind the casting serving as the blank for the camshaft. Such rough-grinding is normally conducted by rotating the camshaft about its axis between centers, lathe-fashion. Meanwhile a driven grinding wheel operated off a master cam performs on the camshaft a grinding operation that gives it the basic shape at the cam and bearing surfaces. Normally several such driven grinding heads are employed at the same time on the camshaft, being driven radially against it in one direction under the guidance of the afore-mentioned master guide cams.

Subsequently the coarse-ground cam surfaces and prefinished by means of coarse prefinish tools, and then finish-ground be means of fine finish tools. These tools are normally either constituted by appropriately shaped ceramic blocks of the appropriate grit, or by synthetic-resin blocks in which the appropriate grit has been embedded. A roughness of about 0.2 microns is normally desired at the end of the prefinishing, and a roughness of about 0.1 microns is desired at the end of the fine-finishing operation.

Typically this is done simply by urging the appropriately shaped tools radially against the camshaft with a predetermined force while rotating the camshaft. The tools will smooth out the coarse-ground surfaces, which smoothing out is sometimes aided by slight axial reciprocation of the camshaft as it is rotated. First the coarse finishing operation is carried out, then the coarse finish tools are removed and the fine finish tools are urged against the cam surfaces.

It is absolutely essential that the cam surfaces be perfectly smooth and perfectly formed. The above-described procedure produces a good product. Nonetheless a more finely finished cam surface will result in substantially descreased wear and correspondingly longer engine life.

OBJECTS OF THE INVENTION

It is therefore an object of the present invention to provide an improved method of and apparatus for finish-grinding a rough-ground camshaft.

Another object is to provide such a method and apparatus which produce a camshaft that is better finished and formed than those produced according to the prior-art system.

SUMMARY OF THE INVENTION

These objects are attained according to the instant invention in a method of the above-described general type wherein each cam surface is associated with a respective tool. According to this invention the camshaft is rotated about its axis and against every other cam surface the respective tool is urged with a predetermined pressure and in a predetermined radial direction while simultaneously the remaining tools are urged against the respective cam surfaces with substantially the same pressure but in the opposite radial direction.

It has astonishingly been found according to the instant invention that one of the principal causes of untrue surfaces on a camshaft was that the camshaft was normally bowed in one direction while being finished. Normally all of the grinding or finishing tools were urged in one radial direction against the respective cam surfaces at the same time, so that obviously the camshaft would be subjected to considerable radial pressure tending to deform it slightly. The result was that all of the surfacees were made slightly frusto conical, tapering outward from the center. As attempts were made under the prior-art system to obtain higher operating speeds, the inevitable answer was always to merely press the abrasive tools against the camshaft with greater pressure, thereby increasing the bowing effect. According to the instant invention this is overcome by directing alternate tools in alternate directions against the camshaft. Thus any radially effective force is only going to exist from one cam surface to the next where it will be countered by an opposite force. There will be no net radially effective force effective on the camshaft between its ends.

This is most easily achieved according to the instant invention by providing the coarse and fine finish tools directly opposite each other, that is to diametrically opposite sides of the camshaft axis. In addition the fine finish and coarse finish tools are on alternate sides of the aixs on the diametrical plane on which all of the tools lie. Thus it is possible to shape the tools by first engaging all of them against the rotating camshaft, and thereafter to pull away only the coarse prefinish tools, leaving the fine finish tools in engagement with the camshaft to finish the operation.

The above-described system not only has the advantage of producing a much truer surface, formed of a family of lines parallel to the axis of the camshaft, but it also allows higher operating speeds to be obtained by allowing the abrasive tools to be urged with considerable force against the camshaft. Since the forces cancel each other out there is no worry about pushing the camshaft out from between the lathe centers on which it is rotated, or about damaging the bearings of the headstock and tailstock.

According to the instant invention each of the tools is mounted on a respective lever pivoted about an axis parallel to the camshaft axis and operated by a respective fluid-powered cylinder. These cylinders exert during engagement of the respective tools with the respective cam surfaces a constant force via the respective tools on the respective surfaces so that even as the respective tools must move radially inwardly and outwardly to follows the ups and downs of the rotating cam surface, the engagement force remains the same.

In accordance with a particular procedure of the instant invention, the coarse prefinish tools and the fine finish tools are all urged to start with against the cams, with the respective prefinish tools engaging each cam surface in one radial direction and the respective finish tools engaging in the radial opposite direction, but of course with the tools of the same type alternating on opposite sides of the axis. After a brief period in which both tools act on the cam surfaces the prefinish tools only are retracted radially away from the cam surfaces so that the final smoothing is carried out only by the fine finish tools. Such a procedure has been found to work extremely well, with no bending of the camshaft whatsoever so that if the cam surfaces are slightly frustoconical for the reasons described above they will be rendered cylindrical. This system according to the instant invention also allows the tools to be pressed with considerable force against the surfaces they are machining, so that higher production rates can be achieved.

SPECIFIC DESCRIPTION

Figure 1:
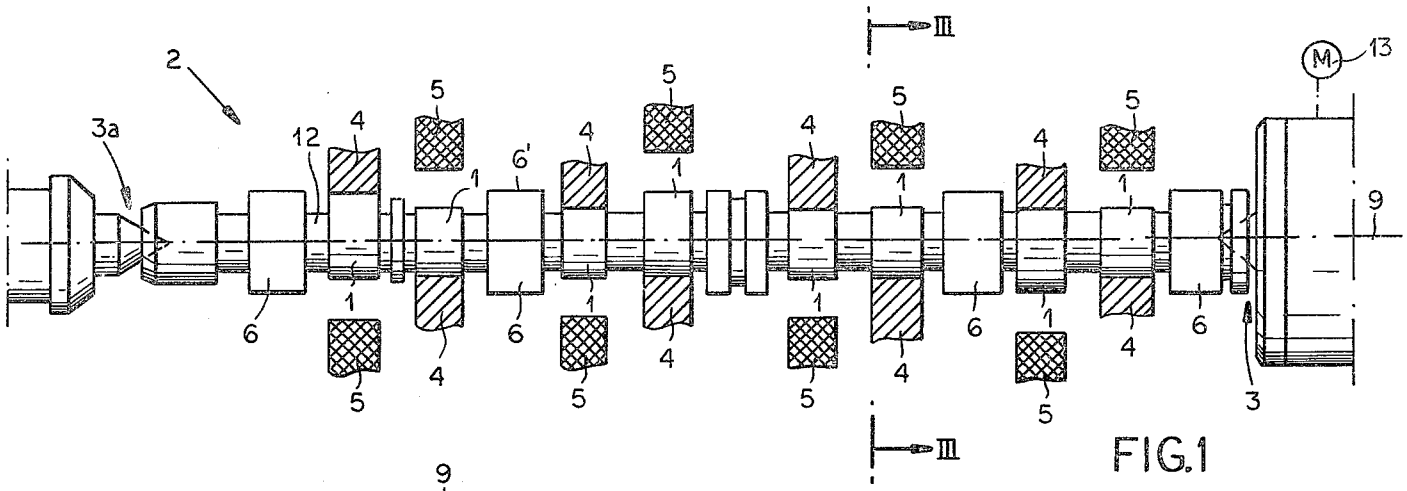
FIG. 1 is a largely schematic side view illustrating the method and apparatus of the instant invention.
Figure 4A:
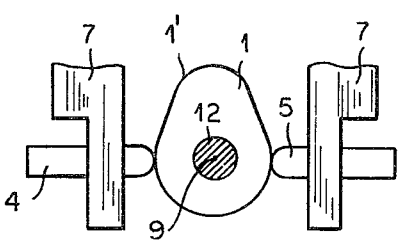
FIGS. 4A–4C illustrate the several steps of the method according to the instant invention.
Figure 4C:
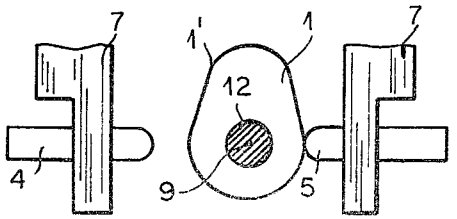
Figure 4B:
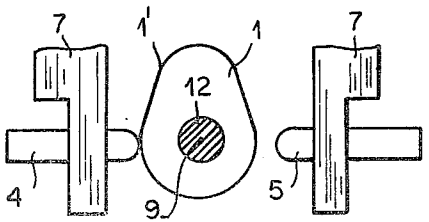

As seen in FIG. 1 a camshaft 2 has a shaft 12 on which are carried a succession of axially spaced valve-lifting cams 1 and several bearing surfaces 6. The cams 1 have as seen in FIGS. 4A–4C outer surfaces 1′ that are not centered on the axis 9, but the outer surfaces 6′ of the bearing surfaces 6 are centered on the axis 9. This camshaft is mounted on centers between a driven headstock 3 operated by a motor 13 and a tailstock 3*a* so that the camshaft 1 is during the below-described finishing operations always rotated at a generally constant speed about its axis 9.

Figure 3:
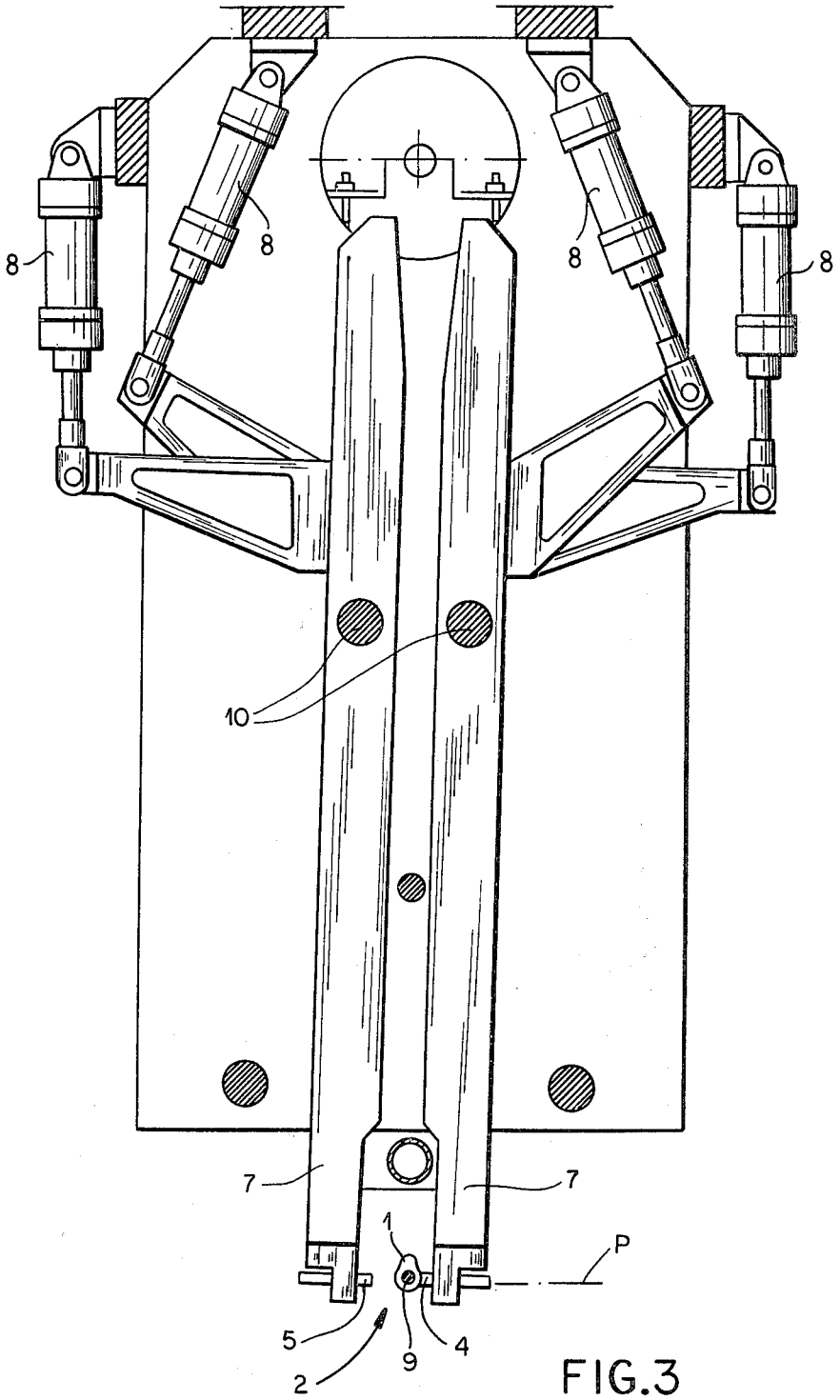
FIG. 3 is a section taken along the line III—III of FIG. 1.

According to this invention there is associated with each cam 1 a coarse prefinish tool or stone 4 and a fine finish stone 5, the former being shown for illustration's sake with a simple diagonal hatching and the latter with cross hatching. These tools 4 and 5 are carried as seen in FIG. 3 on lone first-class levers 7 pivoted at 10 about axes above and to either side of the axis 9 and each associated with a respective fluid-operated cylinder 8 of the double-acting type so that the tools 4 and 5 can be moved into and out of radial engagement with the respective cam surfaces 1′. FIG. 1, which is a top view, shows how the prefinish tools 4 are staggered to opposite sides of the axis 9, as are the finish tools 5.

Figure 2:
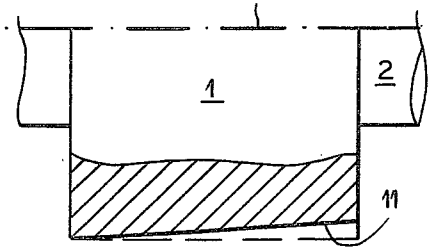
FIG. 2 is a partly sectional large-scale view of a detail of a camshaft prior to machining.

The system according to the instant invention has been found particularly useful in eliminating a common deformation such as shown in 11 of FIG. 2. Thus the cam 1 shown in FIG. 2 has an outer surface which is not formed by a family of lines parallel to the axis 9, but instead by a family of lines that all converge toward and meet the axis 9. This out-of-true condition is the result of a rough grinding that is executed with such force that the entire camshaft 2 is bent to one side, so that from the middle out all of the surfaces 1′ taper outward.

With the system according to the instant invention at first as shown in FIG. 4A both tools 4 and 5 for each cam surface 1′ are uged into radial contact in opposite directions relative to a plane P including the axis 9 with the respective cam surface 1′. During this operation the tips of the tools 4 and 5 are formed somewhat. These tools 4 and 5 may be formed of ceramic blocks of appropriate grit, or of synthetic-resin blocks in which the apropriate grit is embedded.

Thereafter as shown in FIG. 4B the fine-finish tools 5 are withdrawn and only the coarse prefinish tools 4 are urged against the cam surfaces 1. Since the prefinish tools 4 as seen in FIG. 1 also alternate to opposite sides of the axis 9 there will be no measurable bending of the camshaft 2. This feature therefore allows considerable pressure to be exerted by the tools 4 against the surfaces 1′.

Subsequently as shown in FIG. 4C the tools 4 are withdrawn and the tools 5 are all engaged with the respective cams 1. Again since these tools 5 are staggered to opposite sides of the axis 9 they can also exert considerable force.

It is also possible according to the instant invention to skip the step as shown in FIG. 4B and go directly from the step of FIG. 4A to the step FIG. 4C. Thus during the prefinishing both tools 4 and 5 will engage each cam surface 1′. Toward the end of the operation only the prefinish tools 4 are withdrawn from the cams 1 so that the final smoothing is effected by the tools 5 alone.

It is noted that during the above-described operation it is possible to axially slightly reciprocate the camshaft 2 while rotating it about its axis 9. Furthermore it should be noted that the forces exerted by the tools 4 and 5 against the surfaces 1′ are always equal. At the very least the forces exerted by the tools 4 should all be equal and the forces exerted by the tools 5 should all be equal. Normally the forces exerted by all of the tools are equal to one another.

We claim:

1. A method of finish-grinding a rough-ground camshaft having a shaft extending along and defining an axis and carrying a plurality of axially spaced cams each having a cam surface, said method employing for each cam a respective coarse prefinish tool and a respective fine finish tool, said method comprising the stpes of:

rotating said camshaft about said axis;

urging against each cam surface the respective fine finish tool in one radial direction and with a predetermined pressure and the respective coarse prefinish tool with an equal but opposite pressure and in the opposite radial direction, said directions being generally coplanar through said axis and every other finish tool being to one side of said axis on said plane, whereby said tools aternate to either side of said axis in said plane; and after a predetermined interval withdrawing said coarse prefinish tools radially from contact with said cam surfaces while continuing to rotate said camshaft with only said fine finish tools engaging the respective cam surfaces.

2. An apparatus for finish-grinding a rough-ground camshaft having a shaft extending along and defining an axis and carrying a plurality of axially spaced cams each having a cam surface, said apparatus comprising:

means for rotating said camshaft about said axis;

a respective coarse prefinish tool radially displaceable in a predetermined radial direction toward and away from each cam surface;

a respective fine finish tool radially displaceable toward and away from each cam surface in a radial direction diametrally opposite that of the respective coarse prefinish tool;

means including respective fluid-operated cylinders for urging each of said tools in the respective direction against the respective cam surface with a force substantially equal to the force of the opposite respective tool and for pulling the coarse prefinish tools out of engagement with said cam surfaces and thereby leaving only said fine finish tools in engagement therewith; and respective pivoted levers carrying said tools, connected to the respective cylinders, and pivotal about lever axes parallel to the camshaft axis, the levers to the tools displaceable in said predetermined direction being pivotal about a common lever axis and the levers of the tools displaceable in the opposite radial direction being pivotal about a common lever axis.

* * * * *